FIP7811 XR 4,043,598

United States Patent [19]

French et al.

[11] 4,043,598

[45] Aug. 23, 1977

[54] MULTIPLE ZONE PREPARATION OF OIL SHALE RETORT

[75] Inventors: Gordon B. French, Bakersfield; Donald E. Garrett, Claremont, both of Calif.

[73] Assignee: Occidental Oil Shale, Inc., Grand Junction, Colo.

[21] Appl. No.: 659,899

[22] Filed: Feb. 20, 1976

Related U.S. Application Data

[63] Continuation-in-part of Ser. No. 602,930, Aug. 8, 1975, abandoned, which is a continuation of Ser. No. 464,956, Aug. 29, 1974, abandoned.

[51] Int. Cl.[2] ..... E21B 43/26; E21C 41/10

[52] U.S. Cl. ..... 299/2; 166/259; 299/13

[58] Field of Search ..... 299/2, 4, 5, 13; 166/247, 259, 299; 102/23

[56] References Cited

U.S. PATENT DOCUMENTS

| | | | |
|---|---|---|---|
| 1,842,664 | 1/1932 | Elsing | 299/13 X |
| 3,001,776 | 9/1961 | Van Poollen | 299/2 |
| 3,582,138 | 6/1971 | Loofbourow et al. | 299/13 |
| 3,688,843 | 9/1972 | Nordyke | 166/247 |
| 3,712,677 | 1/1973 | Janssen | 299/13 |
| 3,957,306 | 5/1976 | Closmann | 299/4 |

OTHER PUBLICATIONS

Jackson et al. "Stoping Methods and Costs," U.S. Dept. of the Interior, Bureau of Mines Bulletin No. 390, 1936, pp. 2–19.

E. I. Du Pont de Nemours & Company, Blasters Handbook, 1969, pp. 240–244, 343–345.

Cummins et al., SME Mining Engineering Handbook, Society of Mining Engineers, 1972, pp. 12–15, 12–135 through 12–150, and 12–162 through 12–233.

*Primary Examiner*—Stephen J. Novosad
*Assistant Examiner*—George A. Suchfield
*Attorney, Agent, or Firm*—Christie, Parker & Hale

[57] ABSTRACT

A subterranean deposit containing oil shale is prepared for in situ retorting by initially excavating a plurality of vertically spaced apart voids of similar horizontal cross section located one above another within the deposit. A plurality of vertically spaced apart zones of unfragmented deposit are temporarily left between the voids, each unfragmented zone having a thickness of less than about 190 percent of the smallest lateral dimension of the voids above and below it. Explosive placed in each of the unfragmented zones is detonated, preferably in a single round to expand each unfragmented zone into the voids on either side of it and form a subterranean room containing a fragmented mass of particles having a void volume equal to the void violume of the initial voids. Retorting of the expanded mass is then carried out to recover shale oil from the oil shale.

71 Claims, 2 Drawing Figures

MULTIPLE ZONE PREPARATION OF OIL SHALE RETORT

BACKGROUND OF THE INVENTION

This is a continuation-in-part of U.S. patent application Ser. No. 602,930, filed Aug. 8, 1975, which was a continuation of U.S. patent application Ser. No. 464,956 filed Apr. 29, 1974, both of which are now abandoned.

This invention relates to the recovery of constituents from subterranean ore deposits, and more particularly to an in situ method of recovery that is particularly effective for the production of shale oil from oil shale in an in situ retort. The term "oil shale" as used in the industry is in fact a misnomer; it is neither shale nor does it contain oil. It is a formation comprising marlstone deposit containing an organic material called "kerogen" which upon heating decomposes to produce carbonaceous liquid and gaseous products. It is the deposit containing kerogen that is called "oil shale" herein, and the liquid product is called "shale oil".

U.S. Pat. No. 3,661,423 discloses a method of recovering carbonaceous values including shale oil from an oil shale deposit in situ by detonating explosive charges dispersed through the recovery zone of the deposit to produce an expanded mass of oil shale particles. This forms an in situ oil shale retort comprising boundaries of unfragmented shale containing a fragmented permeable mass of oil shale particles. Retorting of the expanded mass is then carried out by igniting the upper level of the expanded deposit to establish a combustion zone. An oxygen containing or supplying gas is introduced into the top of the retort to sustain the combustion zone, which proceeds slowly down through the fragmented shale in the retort. As burning proceeds, the heat of combustion is transferred to the shale below the combustion zone to release shale oil and gases therefrom in a retorting zone. Thus, a retorting zone moves from top to bottom of the retort in advance of the combustion zone, and the resulting shale oil and gases pass to the bottom of the retort for collection.

It is desirable that the expanded mass have a uniformly distributed void volume or void fraction so that gases will flow uniformly through the expanded deposit and result in a maximum conversion of kerogen to shale oil. The creation of a mass of expanded particles of uniform void volume distribution prevents the formation of over-sized voids or channels which hinder total recovery of shale oil and also provides a uniform pressure drop through the entire mass of particles. In preparation for the described retorting process, it is important that the shale be fragmented, rather than simply fractured, in order to create high permeability; otherwise, too much pressure differential is required to pass the gas through the retort.

It has been proposed that deposits be prepared for in situ recovery by first undercutting a portion of the formation to remove about 5% to 25% of the volume of the deposit. The overlying deposit is then expanded by detonating explosives embedded in the deposit to fill the void created by the undercut. One method of explosive expansion is the so-called "V-cut" method in which explosive charges are so arranged within the deposit and detonated in sequence so that the deposit is expanded in concentric sequential steps moving radially outwardly and upwardly within the deposit, generating a conical free face which propagates upwardly through the deposit in accordance with the time delays between the explosive charges. The purpose of the V-cut method of expansion is to produce oil shale particles of relatively small size; but it has the disadvantage of tending to create a radially non-uniform void volume distribution throughout the expanded mass, because the explosive charges tend to push more fragmented particles toward the center of the mass. The general art of blasting rock deposits is discussed in The Blasters' Handbook, 15th Edition, published by E. I. duPont de Nemours & Company, Wilmington, Delaware.

BRIEF SUMMARY OF THE INVENTION

Thus, there is provided in practice of this invention a method of forming an in situ oil shale retort containing a fragmented permeable mass of oil shale particles in a subterranean deposit, which comprises the steps of excavating a plurality of vertically spaced apart voids with a zone of unfragmented deposit between adjacent vertically spaced apart voids and explosively expanding such an unfragmented zone toward adjacent voids to form a fragmented permeable mass of particles in an in situ oil shale retort being formed. Features of the method can include forming the void so that the horizontal cross section of each void is substantially similar to the horizontal cross section of the retort being formed, explosively expanding all of the unfragmented zones toward adjacent voids in a single round, forming a retort wherein the void volume of the fragmented permeable mass of particles in the retort is substantially equal to the total volume of the voids within the boundaries of the retort being formed, or explosively expanding such an unfragmented zone by forming a plurality of vertically extending blasting holes in such an unfragmented zone, placing explosive in the blasting holes and detonating the explosive.

In a particularly preferred embodiment a sufficient number of vertically spaced apart voids are spaced one above another to form a subterranean room produced after explosive expansion of the unfragmented zones having a greater height than width. Such expansion in a deposit containing oil shale forms an in situ retort. Oil shale therein is heated to liquefy carbonaceous values by maintaining a downward flow of hot gas through a retorting zone so that shale oil produced in the retort can be recovered. It is particularly preferred that the thickness of the unfragmented zones between free faces be less than about 190 percent of the smallest lateral dimension of the voids.

BRIEF DESCRIPTION OF THE DRAWINGS

These and other aspects of the invention will be more fully understood by reference to the following detailed description and the accompanying drawings in which.

DETAILED DESCRIPTION

Figure 1:
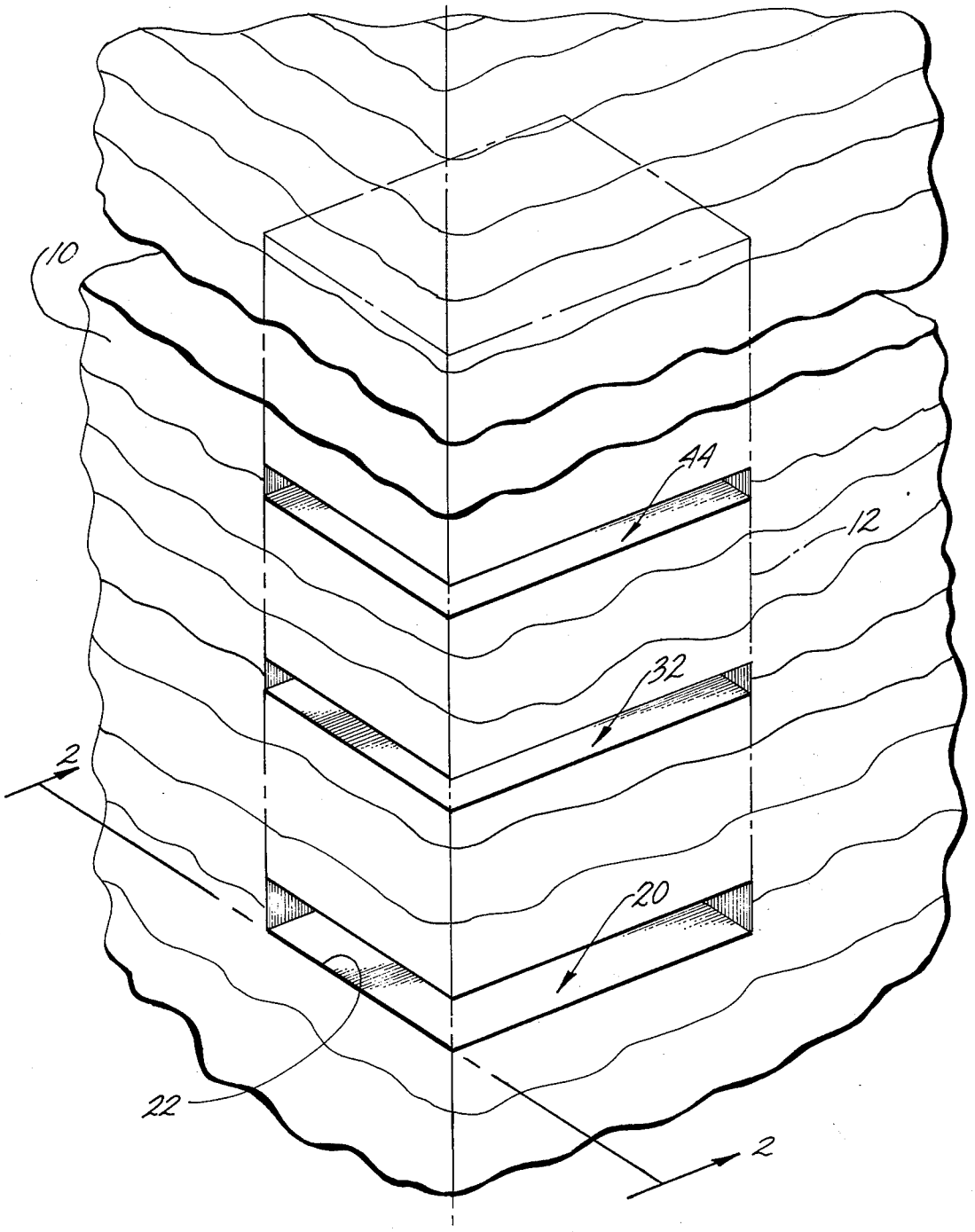
FIG. 1 is a schematic perspective view showing an oil shale deposit in an intermediate stage of preparation for in situ recovery in accordance with principles of this invention.

The drawings illustrate a subterranean deposit 10, such as an oil shale deposit, which is in an intermediate state of preparation for in situ recovery of carbonaceous values such as shale oil and hydrocarbon gaseous products in retorting off gas. Generally speaking, in situ recovery is carried out by initially removing oil shale from certain volumes of the subterranean deposit and then explosively expanding a remaining portion of the oil shale in the deposit to produce a vertically extending fragmented permeable mass of oil shale particles. The present invention will be described in the context of a method for ultimately producing a subterranean vertical retort comprising a vertically extending room 12 (illustrated in phantom lines in FIGS. 1 and 2) filled with a fragmented permeable mass of expanded oil shale particles having a uniformly distributed void volume desired for economical vertical retorting operations. In the illustrated embodiment, the room 12 is square in horizontal cross-section, and for most efficient retorting the vertical dimension or height of the room 12 is greater than the maximum lateral dimension or width of the room.

Figure 2:
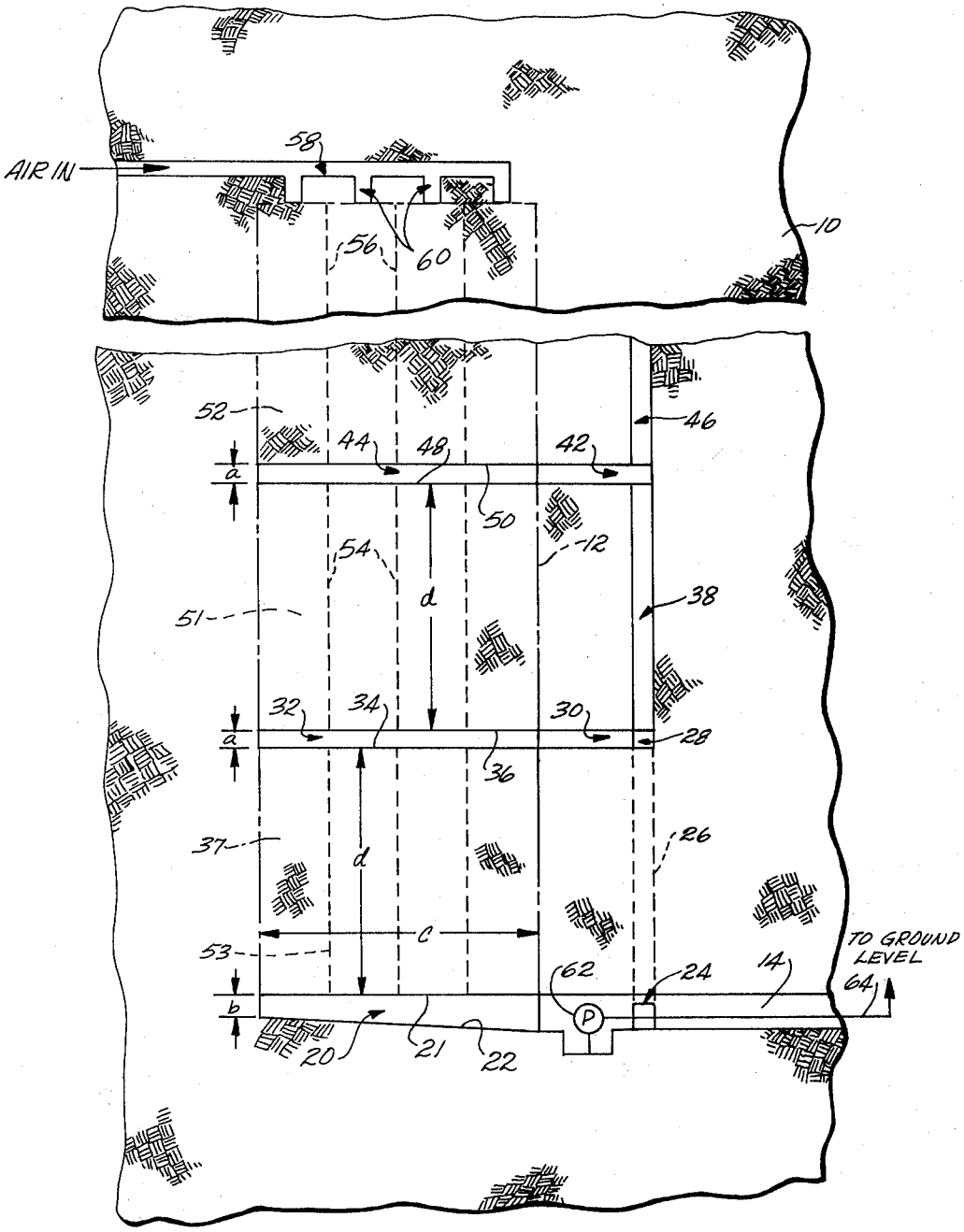
FIG. 2 is a cross-sectional elevation view taken on line 2—2 of FIG. 1.

Referring to FIG. 2, access to the portion of the oil shale deposit to be expanded is established by forming a horizontal tunnel, drift or adit 14 extending to the bottom of the volume to be expanded. From the adit 14, the oil shale deposit is undercut and a volume of deposit is removed to form a lower void 20 at the bottom of the subterranean room 12 to be formed. The material excavated from the lower void is hauled away through the tunnel 14. The lower void 20 is preferably continuous across the width of the volume to be expanded, so that the deposit overlying the lower void is completely unsupported and defines a horizontal free face 21 of the formation immediately above the lower void. If desired one or more pillars of unfragmented deposit can be left in the void to help support overlying deposit. Preferably, the floor plan or horizontal cross section of the lower void 20 is generally square, although the void, and also the subterranean room 12 to be formed generally, can be of other horizontal cross-section such as rectangular without departing from the scope of the invention. The floor 22 of the lower void is inclined downwardly in the direction of the adit 14 to facilitate the flow of shale oil in the direction of the adit during subsequent retorting operations.

After the lower void 20 is excavated, or concurrently therewith, a horizontal or upwardly sloping tunnel or "lateral" 24 is excavated. The far end of the lateral opens into an upwardly inclined tunnel or "raise" 26. The top 28 of the raise 26 provides access for excavating a horizontal tunnel 30 above the level of the bottom void 20. The lateral 24 and raise 26 form a dogleg access to the tunnel 30. Other access can also be provided such as a sloping tunnel from the drift 14 or a separate adit leading to the ground surface. From the horizontal access tunnel 30, oil shale is removed from the volume to be expanded to form an intermediate void 32 spaced vertically above the lower void 20. The floor plan or horizontal cross section of the intermediate void 32 matches the horizontal cross-section and area of the lower void 20 (and the room 12 to be formed). Thus, the intermediate void is preferably square in shape, and is substantially directly above the lower void so that the outer edges of the two voids preferably lie in common vertical planes. The height of the intermediate void can be less than that of the lower void if less bulky mining machinery is employed for excavation. The intermediate void also is continuous across the width of the room 12 such that the overlying portion of the deposit is completely unsupported, thereby defining a pair of vertically spaced apart bottom and top horizontal free faces 34 and 36, respectively, adjoining intermediate void 32. The two voids 20 and 32 also define a lower zone 37 of unfragmented oil shale left within the boundaries of the subterranean room 12 between the free faces 21 and 34.

After the intermediate void 32 is formed, or concurrently therewith, oil shale is removed from the deposit adjacent room 12 being formed to form a vertical raise 38 extending upwardly from the tunnel 30 to provide access for excavating a horizontal tunnel 42 above the level of the intermediate void 32. Oil shale is removed from within the boundaries of the room 12 being formed through the tunnel 42 to form an upper void 44 spaced vertically above the intermediate void 32. The floor plan or horizontal cross section of the upper void 44 is substantially similar to the generally square horizontal cross-section being formed and the lower and intermediate voids of the room 12. The upper void also is aligned with the voids below it so that the outer edges or the upper void lie in common vertical planes with the outer edges of the voids below. The upper void 44 is approximately the same height as the intermediate void 32, and is also continuous across the width of the room 12. Thus, the portion of the deposit above it is completely unsupported. If desired one or more pillars of unfragmented deposit can be left in the upper and intermediate voids to help support the overlying deposit. The upper void defines a pair of vertically spaced apart bottom and top horizontal free faces 48 and 50, respectively, on the unfragmented deposit adjoining the void. The two voids 32 and 44 also define a zone 51 of unfragmented deposit left between the free faces 36 and 48. An intact zone 52 of unfragmented deposit also is left above the uppermost free face 50.

The technique for expanding oil shale illustrated in the drawings has one intermediate void between the upper void and the lower void, although in practice there can be multiple intermediate voids one above another, depending upon the height of the volume to be expanded. Thus, the drawing illustrates a further vertical raise 46 extending upwardly from the tunnel 42 for the purpose of gaining access to a higher level in the deposit in the event multiple intermediate voids are to be excavated within the boundaries of the room 12.

Multiple intermediate voids can be useful where the height of the retort being formed is very much larger than its width. It is preferred that at least one or two intermediate voids be excavated between the top and bottom voids so that the in situ retort has a substantially greater height than width. As pointed out hereinafter, a particularly suitable retorting technique employs downward flow of gas from an upper level of the fragmented permeable mass toward the bottom where products of retorting are recovered. Good gas flow distribution and control of the retorting zone in the retort can be obtained with such a construction.

It is also preferred that the voids have rectangular horizontal cross sections with edges coplanar with each other in common vertical planes. Rectangular retorts are well adapted to close packing of retorts in a region being developed and leave minimal amounts of oil shale in walls or pillars between adjacent retorts. This maximizes total recovery of valuable products from the region. The vertical arrangement of the voids and hence the retorts also furthers recovery from the region while still giving support for overlying deposits.

Conventional underground mining techniques and equipment are used for excavating the voids and the access tunnels, raises and the like.

After the multiple spaced apart voids have been excavated in the oil shale deposit, the intervening unfragmented zones 37 and 51 and the intact oil shale 52 above the upper void 44 are prepared for explosive expansion and subsequent retorting operations. Vertical blasting holes 53 are drilled in the lower unfragmented zones 37 upwardly from the lower void 20 or downwardly from the intermediate void 32. Similarly, vertical blasting holes 54 are drilled in the upper unfragmented zone 51 from the intermediate void 32 or the upper void 44, and vertical blasting holes 56 are drilled upwardly from the upper void 44 into unfragmented deposit 52 above the upper void. If pillars have been left within the voids blasting holes can also be drilled in them for expansion with the fragmented zones. The blasting holes are then filled from top to bottom with explosive such as ammonium nitrate-fuel oil or other conventional explosive. Thus, at this intermediate stage in preparation for in situ retorting explosive charges are distributed in the unfragmented zones between the voids and the unfragmented deposit on the opposite side of one of the voids from the unfragmented zone.

The explosive charges within at least one of the unfragmented zones are detonated simultaneously to expand the unfragmented zone toward the previously excavated voids. This severs the oil shale from the formation to form the room 12 and fill it with a fragmented permeable mass of oil shale particles or rubble. The explosive charges are so arranged within the unfragmented zones of oil shale that the shape of the room 12 after detonation is approximately square in horizontal cross section continuously from top to bottom, as illustrated by phantom lines in FIG. 1. The explosive is dispersed in the unfragmented zones 37 and 51, and in the unfragmented deposit 52 above the top void 44. Explosive is located sufficiently close to the free face of the zone adjoining each void that oil shale in each unfragmented zone is expanded simultaneously into both voids bordering it. Preferably all of the explosives are detonated in a single round so all unfragmented zones are expanded and all voids filled at the same time.

The distributed void fraction of the permeable mass of particles in the retort, i.e., the ratio of the void volume to the total volume in the subterranean in situ retort 12, is controlled by the volume of the excavated voids toward which the deposit is expanded. The total volume of the voids is sufficiently small compared to the total volume of the retort that the expanded oil shale is capable of filling the voids and the space occupied by the expanded shale prior to expansion. In other words, the volume of the voids is not so large that the expanded shale occupies less than the entire space of the voids and the space occupied by the expanded shale prior to detonation of the explosives. In filling the voids and the space occupied by the unfragmented zones prior to fragmentation, the particles of the expanded shale become jammed and wedged together tightly so they do not shift or move after fragmentation has been completed. In numerical terms, the total volume of the voids should be less than about 40% of the total volume of the retort being formed to fill the voids and the space occupied by the expanded shale prior to expansion. In one embodiment of this invention, the volume of the voids is preferably not greater than about 20% of the volume of the retort, as this is found to provide a void volume in the fragmented oil shale adequate for satisfactory retorting operation. If the void volume is more than about 20% an undue amount of excavation occurs without concomitant improvement in permeability. Removal of the material from the voids is costly and kerogen contained therein is wasted or retorted by costly above ground methods.

The total volume of the voids is also sufficiently large compared to the total volume of the retort that substantially all of the expanded shale within the retort is capable of moving enough during explosive expansion to fragment and for the fragments to be displaced and/or reoriented. If the volume of the voids is too small, a significant quantity of the shale within the retort volume can fracture without fragmenting. If the shale fractures without fragmenting, as when the space for explosive expansion of the shale is insufficient, fissures can be formed and the shale frozen in place without fragmentation. The void volume in fractured (but not fragmented) shale is neither large enough nor suitably distributed for efficient in situ retorting, and the permeability is too small to provide a desired gas flow rate through the retort with a reasonable pressure differential.

When the fragmented shale particles are later retorted, they increase in size. Part of this size increase is temporary and results from thermal expansion, and part is permanent and is brought about during the retorting of kerogen in the shale. The void fraction of the fragmented permeable mass of shale particles should also be large enough for efficient in situ retorting as this size increase occurs. In numerical terms, the minimum volume of the voids in view of the above considerations should be above about 10% of the total volume of the retort. Below this average percentage value, an undesirable amount of power is required to drive the gas blowers causing retorting gas to flow through the retort.

Within the preferred range of from about 10% to 20%, the particularly preferred average void fraction is about 15%. Data collected to date from work in the Piceance Basin of Colorado indicate this value provides a good balance among the various characteristics of the retort, i.e., void volume, permeability, and particle size, without having to excavate excessive amounts of oil shale to form the voids. For example, an in situ retort having this void fraction and a height of about 100 feet can have a pressure differential of less than about 1 psi from top to bottom for vertical movement of gas down through the retort at about 1 to 2 standard cubic feet per minute (scfm) per square foot of horizontal cross section of the retort. Retorts having greater heights have proportionally larger pressure drops. Thus, an adequate gas flow rate through retorts up to 1000 feet in height can be provided with a pressure differential of less than about 10 psi from top to bottom. In some areas of the Piceance Basin, a gas pressure of greater than 10 psi is objectionable because it results in excessive gas leakage into unfragmented shale around the retort.

The above percentage values assume that all the shale within the boundaries of the retort is to be fragmented; that is, there are no unfragmented regions left in the retort. If there are unfragmented regions left in the retort, e.g., for support pillars or the like, the percentages would be less.

Physical characteristics of conventional explosive expansion place an apparent limit on the thickness of oil shale which can expanded in a single round. The maximum thickness or depth of oil shale which can reliably be fragmented is about 95% of the minimum lateral dimension of a void into which it expands. If one attempts to explosively expand oil shale from a thickness or depth greater than about 0.95 times the smallest lateral dimension of the free face adjoining the void towards which expansion occurs, incomplete fragmentation can occur. The oil shale near the free face and at distances up to 0.95 times its smallest lateral dimension can expand and fragment. Oil shale further from the free face may not fragment thoroughly because of physical constraints imposed by surrounding unfragmented rock. Explosive in such oil shale further from the free face can cause fracturing, which would yield insufficient permeability for good in situ oil shale retorting.

In the embodiment described herein the unfragmented zone has two parallel free faces between a pair of adjoining spaced apart voids and can expand toward both voids simultaneously. This affords relief from the constraint of 95% which characterizes expansion into a single void adjoining a single free face. Absent special techniques, upon explosive expansion particles move toward the nearer free face. Any constraints due to unfragmented oil shale are applied to no more than half of the expanding oil shale. Thus the unfragmented zone can be twice as thick as would otherwise be the case and still be explosively expanded. Expansion of the unfragmented deposit toward spaced apart voids upon detonation of explosives in the unfragmented zone is preferably practiced with a thickness of the unfragmented zone greater than about 95 percent of the smallest lateral dimension of the adjoining voids. Expansion of a thickness of oil shale less than about 95% of the minimum lateral dimension or width of the adjoining voids can be accomplished with only a single void in many situations. In such a case there is little reason to go to the extra expense of a second void toward which the oil shale can expand. The thickness of the unfragmented zone between adjoining voids should be less than about 190 percent of the smallest lateral extent of the voids. This promotes full fragmentation with minimal possibility of unfragmented masses of appreciable size remaining in the fragmented permeable mass of particles.

Preferably the maximum thickness of each zone of unfragmented oil shale within the retort is in the range of from about 95 to 190 percent of the minimum horizontal dimension of the free faces of the zone or the voids toward which the unfragmented zone is expanded.

In one example of practice of this invention, the total height of the in situ retort or room 12 is about 110 to 120 feet. The intermediate void 32 and upper void 44 each have a height (represented by the dimension *a* in FIG. 2) of about 6 feet, and the height (represented by the dimension *b*) of the lower void is about 12 feet. Each unfragmented zone 37 and 51 and the unfragmented shale 52 above the top void is about 32 feet square (represented by dimension *c* in FIG. 2) in horizontal cross section, which essentially matches the horizontal cross section of the voids 20, 32 and 44, although these can be a foot or so wider to accommodate drilling equipment near the edges. The thickness (represented by the dimension *d*) of each unfragmented zone, and the upper zone 52 above the upper void is about 30 feet, i.e., about 95% of the minimum horizontal dimension of the voids.

About six feet of rubble in the form of oil shale particles are back-filled in the lower void 20 prior to expansion. Explosive dispersed in blasting holes in the unfragmented zones and in unfragmented oil shale above the top void is detonated for expanding the unfragmented deposit toward the voids.

Thus, in this example, the fragmented permeable mass of particles contained in the in situ retort 12 after explosive expansion has a void volume of about 15%. As described above, this void volume is within the desired range for maximizing recovery of shale oil from the volume being retorted and providing for a minimal pressure drop from top to bottom of the vertical retort.

In another example, three vertically spaced apart voids are excavated in a deposit with the lower void having a height of about 12 feet and being about 80 feet by 120 feet in rectangular horizontal cross section. The upper and intermediate voids have the same cross section and are each about 24 feet high. A zone of unfragmented deposit about 140 feet thick is left between the lower void and the intermediate void directly above it. A similar unfragmented zone about 140 feet thick is left between the intermediate void and the overlying upper void. Thus, the minimum lateral dimension of the voids is about 80 feet and the thickness of each unfragmented zone is about 175 percent of that dimension. Vertical blasting holes are drilled downwardly into each unfragmented zone and loaded with explosive. Blasting holes are also drilled upwardly about 60 feet into the intact deposit above the upper void and loaded with explosive. The explosives are detonated with short time delays in a single round so that the lower unfragmented zone expands toward the lower and intermediate voids, the upper unfragmented zone expands toward the upper void and about 60 feet of deposit above the upper void expands toward the upper void. This results in a subterranean room about 400 feet high and 80 by 120 feet in horizontal cross section. It is filled with fragmented deposit having an average void volume of about 15 percent.

Because of the limited thickness of each unfragmented zone 37, 51, the entire volume of each zone can be fragmented completely by a detonation of all explosive charges contained in the zone in a single round, i.e. either simultaneously or in an uninterrupted sequence with short time delays to enhance fragmentation. Therefore this avoids the need for fragmenting shale in sequential V-cuts which does not produce an entirely uniform distribution of void volume, as described above.

Further, the oil shale in the spaced apart unfragmented zones is preferably all expanded at substantially the same time. That is, explosives in both unfragmented zones 37 and 51 and in the intact oil shale 52 above the upper void are detonated simultaneously or with no more than short time delays. This permits concurrent expansion of oil shale towards the void from unfragmented zones on both sides of the void. Simultaneous expansion prevents filling of the void by fragments from one unfragmented zone before the other, which event could result in incomplete fragmenting of the zone that was later.

Following explosive expansion of the oil shale, at least one gas access communicating with an upper level of the retort 12 is established by forming a horizontal tunnel 58 and several communicating vertical conduits 60 to the top level of the expanded oil shale contained in the room.

The recovery of shale oil and gaseous products from the oil shale in the retort generally involves the movement of a retorting zone through the fragmented permeable mass of particles in the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries so that the shale oil and product gases produced in the retorting zone will move by the force of gravity and with the aid of gases (air or heated gases) introduced at an upper level and moving toward the base of the retort for collection and recovery.

A combustion zone can be established at or near the upper boundary of a retort by any of a number of methods. Reference is made to application Ser. No. 536,371, filed Dec. 26, 1974, now abandoned by Chang Yul Cha, and assigned to the assignee of the present application, for one method in which an access conduit 56 is provided to the upper boundary of the retort, a combustible gaseous mixture is introduced therethrough, and ignited in the retort. Off gas is withdrawn through an access means (such as the tunnel 14) extending to the lower boundary of the retort, thereby bringing about a movement of gases from top to bottom of the retort through the fragmented oil shale. A combustible gaseous mixture of a fuel, such as propane, butane, natural gas, or retort off gas, and air is introduced through the access conduit to the upper boundary and is ignited to initiate a combustion zone at or near the upper boundary of the retort. Combustible gaseous mixtures of oxygen and other fuels are also suitable. The supply of the combustible gaseous mixture to the combustion zone is maintained for a period sufficient for the oil shale at the upper boundary of the retort to become heated, usually to a temperature of greater than about 900° F., (although retorting begins at about 600° F.) so that combustion can be maintained by the introduction of air (without fuel gas) into the combustion zone. Such a period can be from about one day to about a week in duration.

The combustion zone is maintained and advanced through the retort toward the lower boundary by introducing an oxygen-containing inlet gas through access conduits to the upper boundary of the retort and withdrawing gas from below the retorting zone. The inlet gas is generally a mixture of air and a diluent such as retort off gas or water vapor having an oxygen content of about 10% to 20% of the volume of the inlet gas. The inlet gas is moved through the retort at a rate of about 0.5 to 2 standard cubic feet of gas per minute per square foot of cross-sectional area of the retort.

The introduction of an inlet gas at the top and the withdrawal of off gases from the retort at a lower level serves to maintain a downward pressure differential of gas to carry hot combustion product gases and non-oxidized inlet gases (such as nitrogen, for example) from the combustion zone downwards through the retort. This flow of hot gas establishes a retorting zone on the advancing side of the combustion zone wherein expanded oil shale is heated and carbonaceous values therein liquefied. In the retorting zone, kerogen in the oil shale is converted to liquid and gaseous products. The liquid products, including shale oil, move by the force of gravity to the base of the retort where they are collected and withdrawn. The gaseous products from the retorting zone mix with the gases moving downwardly through the in situ retort and are removed as retort off gas from a level below the retorting zone. The retort off gas is the gas removed from such lower level of the retort and includes inlet gas, flue gas generated in the combustion zone, and product gas generated in the retorting zone.

Many oil shale deposits have bedding plane dips of less than about 5°, in which case the edges of the vertically spaced apart voids should be in a substantially vertical plane and the resulting retort has substantially vertical side boundaries. If the dip of the oil shale deposit is more than about 5°, the voids can have their edges offset and be tilted so that the free faces of the intervening unfragmented zone are substantially parallel to the plane of the deposit. The result would be a retort that is re-oriented accordingly to conform to the bedding plane so that the side boundaries of the retort are perpendicular to the bedding plane. This provides ail shale having approximately the same kerogen content across the retorting zone at any particular time as it advances through the retort.

The above described use of the invention for recovering carbonaceous values including shale oil from oil shale deposits is for illustrative purposes only, and is not considered to be a limitation of the scope of the invention. For example, the invention can be used in a variety of instances where it is desirable to prepare subterranean ore deposits for in situ recovery where the particle size and subsequent void volume distribution of the ore particles are to be controlled to maximize the recovery of constituents from the deposit.

What is claimed is:

1. A method for fragmenting a subterranean deposit comprising the steps of excavating a plurality of vertically spaced apart voids of substantially similar horizontal cross section including a lower void and at least one void located substantially directly above said lower void, thereby leaving an intervening unfragmented zone of deposit between adjacent voids, and explosively expanding each unfragmented zone toward the previously excavated voids to produce a subterranean room containing a fragmented permeable mass of particles having an average void volume substantially equal to the total volume of the voids by detonating explosive in each unfragmented zone between adjacent voids and located sufficiently close to the free face between the unfragmented zone and adjacent voids to expand the unfragmented zone toward each void.

2. The method according to claim 1 wherein the step of excavating comprises forming a sufficient number of vertically spaced apart voids to form a subterranean room produced after explosive expansion of the unfragmented zones having a greater height than width.

3. The method according to claim 2 comprising excavating each void to a generally rectangular horizontal cross section wherein the corresponding edges of the rectangles are generally coplanar with one another so that the room produced after expansion of the unfragmented zones is of generally rectangular horizontal cross section from top to bottom.

4. The method according to claim 1 wherein the excavating step comprises spacing adjacent voids apart so that the vertical dimension of each intervening unfragmented zone is a maximum of about 190 percent of the minimum lateral dimension of the voids toward which it is to be expanded.

5. The method according to claim 1 wherein the volume of the voids is sufficiently small that expanded particles fill the voids and the space occupied by the unfragmented zone prior to expansion and sufficiently large that the unfragmented zone is fragmented upon detonation of explosive in the unfragmented zone.

6. The method according to claim 1 wherein the combined volume of the voids is in the range of from about 10% to 20% of the total volume of the subterranean room being formed.

7. The method according to claim 1 wherein the explosively expanding step comprises detonating the explosive in all of said unfragmented zones in a single round.

8. The method according to claim 1 wherein all of the explosive in an unfragmented zone is detonated simultaneously.

9. A method of retorting of oil shale in an in situ oil shale retort in a subterranean deposit containing oil shale comprising the steps of:

excavating a plurality of vertically spaced apart voids of substantially similar horizontal cross section including a lower void and at least one void located substantially directly above said lower void, thereby leaving an intervening unfragmented zone of deposit between adjacent voids;

explosively expanding each unfragmented zone toward the previously excavated voids to produce an in situ retort containing a fragmented, permeable mass of oil shale particles having an average void volume substantially equal to the total volume of the voids by detonating explosive in each unfragmented zone between adjacent voids and sufficiently close to the free face of the unfragmented zone to expand oil shale into each void;

heating the oil shale to liquefy carbonaceous values therein by maintaining a downward pressure differential of gas through the mass of oil shale particles; and recovering shale oil from the base of the in situ retort.

10. The method according to claim 9 wherein the step of excavating comprises forming a sufficient number of vertically spaced apart voids to form an in situ retort produced after explosive expansion of the unfragmented zones having a greater height than width.

11. The method according to claim 9 comprising excavating each void to a generally rectangular horizontal cross section wherein the corresponding edges of the rectangles are generally coplanar with one another so that the in situ retort produced after expansion of the unfragmented zones is of generally rectangular horizontal cross section from top to bottom.

12. The method according to claim 9 wherein the excavating step comprises spacing adjacent voids apart so that the vertical dimension of each intervening unfragmented zone is a maximum of about 190 percent of the minimum lateral dimension of the voids toward which it is to be expanded.

13. The method according to claim 9 wherein the combined volume of the voids is in the range of from about 10% to 20% of the total volume of the in situ retort being formed.

14. The method according to claim 9 wherein the explosively expanding step comprises detonating the explosive in all of said unfragmented zones in a single round.

15. A subterranean deposit in an intermediate stage in preparation for in situ recovery of constituents from the deposit comprising a plurality of voids of substantially similar horizontal cross section located at vertically spaced apart levels, one above another within the deposit; an unfragmented zone of deposit between each adjacent pair of such voids, each unfragmented zone having a thickness of less than about 190 percent of the smallest lateral dimension of the voids located adjacent such an unfragmented zone; and a plurality of explosive charges in each unfragmented zone between adjacent voids and sufficiently close to the free face of the unfragmented zone adjacent each void that detonation of the explosive charges will expand the unfragmented zone into each void and form a subterranean room containing a fragmented, permeable mass of particles having an average void volume substantially equal to the volume of the voids.

16. A subterranean deposit according to claim 15 wherein the total volume of the voids is sufficiently small that expanded deposit particles will fill the voids and the space occupied by the unfragmented zone prior to expansion and sufficiently large that expanded deposit from the unfragmented zone will be fragmented upon detonation of the explosive charges in the unfragmented zone.

17. A subterranean deposit according to claim 15 wherein the top void and bottom void are sufficiently spaced apart that the subterranean room produced after expansion of the unfragmented zones has a substantially greater height than width.

18. A subterranean deposit according to claim 17 in which the horizontal cross section of each void is generally rectangular, and the corresponding edges of the rectangles are coplanar with one another so that the room produced after expansion of the deposit is a vertically extending void of rectangular horizontal cross section from top to bottom.

19. A subterranean deposit according to claim 15 in which the combined volume of the voids is in the range of from about 10% to 20% of the total volume of the subterranean room produced after expansion of the deposit.

20. A method of forming an in situ oil shale retort containing fragmented oil shale particles in a subterranean oil shale deposit by the explosive expansion of oil shale toward voids excavated in the deposit which comprises the steps of:

excavating within said formation a plurality of spaced apart voids and leaving an unfragmented zone of deposit between the voids, said unfragmented zone having substantially parallel free faces of deposit adjoining the voids, said unfragmented zone having a thickness between the free faces adjacent the voids less than about 190 percent of the smallest lateral dimension of the free faces of the unfragmented zone adjacent the voids, the volume of the voids toward which the unfragmented zone is to be expanded being:

a. sufficiently small that expanded oil shale particles fill the voids and the space occupied by the unfragmented zone prior to expansion, and b. sufficiently large that expanded oil shade from the unfragmented zone is fragmented upon expansion; and explosively expanding said unfragmented zones toward a plurality of said spaced apart voids at substantially the same time to form said in situ oil shale retort.

21. A method as recited in claim 20 wherein the volume of the voids toward which the the unfragmented zone is to be expanded is greater than about 10% of the combined volume of the voids plus the space occupied by the unfragmented zone which is to be expanded.

22. A method as recited in claim 20 wherein the volume of the voids toward which the unfragmented zone is to be expanded is in the range of from about 10% to about 20% of the combined volume of the voids plus the space occupied by the unfragmented zone prior to expansion.

23. A method as recited in claim 20 further comprising the step of explosively expanding a portion of unfragmented deposit on the opposite side of at least one of said voids from the free face of the unfragmented zone, toward said void at substantially the same time as the unfragmented zone is expanded toward said void.

24. A method of forming a fragmented mass of particles in a subterranean formation by the explosive expansion of a portion of the formation towards voids excavated in the formation which comprises the steps of:

excavating within said formation a plurality of vertically spaced apart voids and leaving an unfragmented zone of formation between adjacent voids, the unfragmented zone having substantially horizontal free faces of deposit adjoining the voids, said unfragmented zone having a thickness between the substantially horizontal free faces of less than about 190 percent of the smallest lateral dimension of the the free faces of the unfragmented zone adjoining the voids toward which said portion of unfragmented zone is to be expanded; and explosively expanding said portion of said unfragmented zone toward the free faces of the unfragmented zone adjoining said voids to form said fragmented mass.

25. A method as recited in claim 24 wherein the volume of the voids toward which the portion of the unfragmented zone is to be expanded is:

a. sufficiently small that the expanded portion fills the volumes of the voids and the space occupied by the portion of the unfragmented zone prior to the expansion, and b. sufficiently large that the portion of the unfragmented zone is fragmented upon detonation of explosive in the unfragmented zone.

26. The method as recited in claim 24 wherein the volumes of the voids toward which the portion of the unfragmented zone is to be expanded is greater than about 10% of such volumes of the voids and of the space occupied by said portion of the unfragmented zone prior to expansion.

27. A method as recited in claim 24 wherein the volume of the voids toward which the portion of the unfragmented zone is to be expanded is in the range of from about 10% to about 20% of such volumes of the voids and of the space occupied by said portion of the unfragmented zone prior to expansion.

28. A method as recited in claim 24 wherein the portion of the unfragmented zone which is to be expanded is explosively expanded by drilling a plurality of vertical blasting holes into said portion of the unfragmented zone, loading explosive into the blasting holes, and detonating the explosive.

29. A method of recovering shale oil from a subterranean oil shale deposit, which comprises the steps of:

excavating a plurality of vertically spaced apart voids with a zone of unfragmented oil shale between adjacent voids, such an unfragmented zone having a horizontal free face of deposit adjacent an upper void and a horizontal free face of deposit adjacent a lower void, said unfragmented zone having a thickness greater than about 95 percent and less than about 190 percent of the smallest lateral dimension of the free face of deposit located above and below such zone of unfragmented oil shale;

explosively expanding the unfragmented zone toward the free faces of deposit above and below it in a single round to form an in situ retort containing a fragmented permeable mass of oil shale particles;

supplying gas to the top of the expanded oil shale for establishing a retorting zone in the fragmented permeable mass and a downward flow of hot gas through the retorting zone; and recovering shale oil from the bottom of the expanded oil shale.

30. A method as recited in claim 29 wherein the volume of the voids is in the range of from about 10 to 20 percent of the volume of the in situ retort to be formed.

31. A method as recited in claim 29 wherein each of said voids is square in horizontal cross section, the outer edges of the voids lie in common vertical planes, and further wherein the height of the in situ retort formed by explosively expanding the oil shale is greater than its width.

32. A method as recited in claim 29 wherein the intact oil shale is prepared for explosive expansion by forming vertical blasting holes dispersed through the unfragmented zone of oil shale between the voids.

33. A method of forming an in situ oil shale retort containing a fragmented permeable mass of oil shale particles in a subterranean deposit, which comprises the steps of:

forming a plurality of vertically spaced apart voids with a zone of unfragmented deposit between adjacent vertically spaced apart voids, said unfragmented zone having a free face of deposit adjoining each of the adjacent vertically spaced apart voids;

forming a plurality of vertically extending blasting holes in such an unfragmented zone;

placing explosive in the blasting holes; and detonating the explosive for explosively expanding such an unfragmented zone toward such adjacent free faces to form a fragmented permeable mass of particles in an in situ oil shale retort being formed.

34. A method as recited in claim 33 wherein the volume of the voids is in the range of from about 10 to 20 percent of the volume of the in situ retort to be formed.

35. A method as recited in claim 33 wherein the unfragmented zone has a thickness of no more than about 190 percent of the smallest lateral dimension of the free faces of deposit toward which it is to be expanded.

36. A method as recited in claim 35 wherein the unfragmented zone has a thickness of more than about 95% of the smallest lateral dimension of the free faces of deposit toward which it is to be expanded.

37. A method as recited in claim 33 wherein the void volume of the fragmented permeable mass of particles in the in situ oil shale retort is substantially equal to the total volume of the voids within the boundaries of the in situ oil shale retort being formed.

38. A method as recited in claim 37 wherein the horizontal cross section of each void is substantially similar to the horizontal cross section of the in situ oil shale retort being formed.

39. A method as recited in claim 33 wherein all such unfragmented zones between adjacent voids in an in situ oil shale retort being formed are explosively expanded towards adjacent free faces in a single round.

40. A method as recited in claim 33 wherein one or more pillars of unfragmented deposite are left in such a void and further comprising explosively expanding such a pillar.

41. A method of forming an situ oil shale retort containing a fragmented permeable mass of oil shale particles in a subterranean deposit which comprises the steps of:

excavating a plurality of vertically spaced apart voids with a zone of unfragmented deposit between adjacent vertically spaced apart voids, each of said voids being substantially rectangular in horizontal cross section with the outer edges of the voids lying in common vertical planes;

explosively expanding such an unfragmented zone between adjacent vertically spaced apart voids to form a fragmented permeable mass of particles in an in situ oil shale retort being formed; and further wherein the height of the in situ oil shale retort is greater than its width.

42. A method of recovering shale oil from a subterranean oil shale deposit which comprises the steps of:

excavating a plurality of vertically spaced apart voids with a zone of unfragmented deposit between adjacent vertically spaced apart voids wherein the horizontal cross section of each void is substantially similar to the horizontal cross section of the in situ oil shale retort being formed;

explosively expanding such an unfragmented zone between adjacent vertically spaced apart voids and oil shale above the top void toward the voids to form a fragmented permeable mass of particles in an in situ oil shale retort being formed;

supplying gas to the top of the fragmented permeable mass for establishing a retorting zone in the fragmented permeable mass and a downward flow of hot gas through the retorting zone; and recovering shale oil produced in the in situ oil shale retort.

43. A method as recited in claim 42 wherein the volume of the voids is in the range of from about 10 to 20 percent of the volume of the in situ retort to be formed.

44. A method as recited in claim 42 wherein the zone of intact oil shale has a thickness of no more than about 190 percent of the smallest lateral dimension of the voids into which it is to be expanded.

45. A method as recited in claim 42 wherein each of said voids is rectangular in horizontal cross section, the outer edges of the voids lie in common vertical planes, and further wherein the height of the in situ retort is greater than its width.

46. A method of forming an in situ oil shale retort containing a fragmented permeable mass of oil shale paticles in a subterranean deposit, which comprises the steps of:

excavating a plurality of vertically spaced apart voids with a zone of unfragmented deposit between adjacent voids and within the boundaries of the in situ oil shale retort being formed; and explosively expanding such an unfragmented zone toward adjacent voids to form a fragmented permeable mass of particles in an in situ oil shale retort being formed, wherein the void volume of the fragmented permeable mass of particles in the in situ oil shale retort is substantially equal to the total volume of the voids within the boundaries of the in situ oil shale retort being formed.

47. A method as recited in claim 46 wherein the horizontal cross section of each void is substantially similar to the horizontal cross section of the in situ oil shale retort being formed.

48. A method as recited in claim 46 wherein all such unfragmented zones between adjacent voids in an in situ oil shale retort being formed are explosively expanded towards adjacent free faces in a single round.

49. A method as recited in claim 48 wherein the explosive expansion of an unfragmented zone comprises the steps of:

forming a plurality of vertically extending blasting holes in such an unfragmented zone; and placing explosives in the blasting holes; and thereafter detonating the explosives for explosively expanding such an unfragmented zone toward adjacent voids.

50. A method as recited in claim 46 wherein such an unfragmente zone has a thickness greater than about 95% and less than about 190% of the smallest lateral dimension of such adjacent vertically spaced apart voids.

51. A method as recited in claim 46 wherein one or more pillars of unfragmented deposit are left in such a void and further comprising explosively expanding such a pillar.

52. A method as recited in claim 51 wherein unfragmented oil shale is prepared for explosive expansion by forming vertical blasting holes in the unfragmented zone between the voids and in intact oil shale above the top void.

53. A method of forming an in situ oil shale retort containing a fragmented permeable mass of oil shale particles in a subterranean deposit, which comprises the steps of:

excavating a plurality of vertically spaced apart voids with zones of unfragmented deposit between adjacent vertically spaced apart voids; and explosively expanding all of the unfragmented zones toward adjacent voids in a single round of form a fragmented permeable mass of particles in an in situ oil shale retort being formed.

54. A method as recited in claim 53 wherein the horizontal cross section of each void is substantially similar to the horizontal cross section of the in situ oil shale retort being formed.

55. A method as recited in claim 54 wherein the void volume of the fragmented permeable mass of particles in the in situ oil shale retort is substantially equal to the total volume of the voids within the boundaries of the in situ oil shale retort being formed.

56. A method as recited in claim 53 wherein each of said voids is substantially rectangular in horizontal cross section, the outer edges of the voids lie in common vertical planes and further wherein the height of the in situ oil shale retort is greater than its width.

57. A method as recited in claim 56 wherein one or more pillars of unfragmented deposit are left in such a void and further comprising explosively expanding such a pillar.

58. A method of forming an in situ oil shale retort containing a fragmented permeable mass of oil shale particles in a subterranean deposit, which comprises the steps of:

excavating a plurality of vertically spaced apart voids with a zone of unfragmented deposit between adjacent vertically spaced apart voids, wherein the horizontal cross section of each void is substantially similar to the horizontal cross section of the in situ oil shale retort being formed; and explosively expanding such an unfragmented zone to form a fragmented permeable mass of particles in the in situ oil shale retort being formed.

59. A method as recited in claim 58 wherein the explosive expansion of an unfragmented zone comprises the steps of:

forming a plurality of vertically extending blasting holes in such an unfragmented zone; and placing explosives in the blasting holes; and thereafter detonating the explosives for explosively expanding such an unfragmented zone toward adjacent voids.

60. A method as recited in claim 59 wherein all such unfragmented zones between adjacent voids in an in situ oil shale retort being formed are explosively expanded towards adjacent free faces in a single round.

61. A method as recited in claim 60 wherein the void volume of the fragmented permeable mass of particles in the in situ oil shale retort is substantially equal to the total volume of the voids within the boundaries of the in situ oil shale retort being formed.

62. A method as recited in claim 61 wherein such an unfragmented zone has a thickness greater than about 95% and less than about 190% of the smallest lateral dimension of such adjacent vertically spaced apart voids.

63. A method as recited in claim 62 wherein the volume of the voids is in the range of from about 10 to 20% of the volume of the in situ oil shale retort being formed.

64. A method as recited in claim 58 wherein such an unfragmented zone has a thickness greater than about 95% and less than about 190% of the smallest lateral dimension of such adjacent vertically spaced apart voids.

65. A method as recited in claim 64 wherein the volume of the voids is in the range of from about 10 to 20% of the volume of the in situ oil shale retort being formed.

66. A method as recited in claim 58 wherein one or more pillars of unfragmented deposit are left in such a void and further comprising explosively expanding such a pillar.

67. A method as recited in claim 58 further expanding unfragmented deposit above the top void toward the top void.

68. A method as recited in claim 58 further comprising the step of explosively expanding oil shale above the uppermost void toward the uppermost void to form a portion of a fragmented permeable mass of particles in the in situ oil shale retort being formed.

69. A method of forming an in situ oil shale retort containing a fragmented permeable mass of oil shale particles in a subterranean deposit which comprises the steps of:

excavating a first void at a lower level in the deposit;

excavating a second void at an intermediate level above the first void leaving a first zone of unfragmented deposit between the first and second voids;

excavating a third void at an upper level above the second void leaving a second zone of unfragmented deposit between the second and third voids; and explosively expanding both the first and second unfragmented zones toward said voids in a single round.

70. A method as recited in claim 69 wherein the explosive expansion of unfragmented oil shale comprises the steps of forming vertical blasting holes in the first and second unfragmented zones, placing explosive in the blasting holes, and detonating the explosive in the blasting holes in a single round.

71. A method of forming an in situ oil shale retort containing a fragmented permeable mass of oil shale particles in a subterranean deposit which comprises the steps of:

excavating a first void at a lower level in the deposit;

excavating a second void at an upper level above the first void leaving a zone of unfragmented deposit between the first and second vertically spaced apart voids, said unfragmented zone having substantially parallel horizontal free faces of deposit adjoining the first and second voids;

placing explosive in the unfragmented zone between the free faces; and detonating the explosive in a single round for explosively expanding the unfragmented zone toward both free faces at the same time.

* * * * *